US006116941A

United States Patent [19]

Kuo

[11] Patent Number: 6,116,941

[45] Date of Patent: Sep. 12, 2000

[54] DEVICE FOR LOCKING TWO MATING CONNECTORS

[75] Inventor: Peter Kuo, Chung-Ho, Taiwan

[73] Assignee: Hon Hai Precision Ind. Co., Ltd., Taipei Hsien, Taiwan

[21] Appl. No.: 09/361,686

[22] Filed: Jul. 27, 1999

[30] Foreign Application Priority Data

Dec. 24, 1998 [TW] Taiwan ..... 87221551

[51] Int. Cl.[7] ..... H01R 13/627

[52] U.S. Cl. ..... 439/357

[58] Field of Search ..... 439/350, 353, 439/357, 358

[56] References Cited

U.S. PATENT DOCUMENTS 5,401,189 3/1995 Sato ..... 439/607

5,741,150 4/1998 Stinson et al. ..... 439/358

5,775,931 7/1998 Jones ..... 439/358

*Primary Examiner*—Gary F Paumen

*Attorney, Agent, or Firm*—Wei Te Chung

[57] ABSTRACT

A locking device for engaging first and second mating connectors together comprises first and second locking members respectively retained in the first and second connectors. The first locking member has a globular engaging portion extending beyond the first connector. The second locking member has a U-shaped latch extending beyond the second connector. The latch defines an arcuate cutout at a free end thereof. The latch provides a pair of beveled edges on periphery of the cutout. The engaging portion of the first locking member slides to engage with the latch of the second locking member through the cutout aided by the beveled edges of the cutout. A rear face of the engaging portion abuts the free end of the latch to establish secure engagement between the first and second locking members.

6 Claims, 3 Drawing Sheets

DEVICE FOR LOCKING TWO MATING CONNECTORS

BACKGROUND OF THE INVENTION

The present invention relates to a locking device for engaging first and second mating connectors together.

Electrical connection between two mating connectors is often adversely effected by vibration or an unexpected external force. In order to protect the connection from such disturbances, the mating connectors often have engageable locking devices for securely joining the two connectors together. U.S. Pat. No. 5,401,189 and Taiwan Patent Application No. 84201383 disclose such connectors.

Referring to FIG. 1, a conventional connector 60 comprises a dielectric housing 70, a plurality of conductive contacts 71 received in the housing 70, a shield 72 covering a front portion of the housing 70 and a pair of securing members 73 for locking the connector 60 and a mating connector (not shown) together. The housing 70 defines a pair of apertures 74 in opposite ends thereof for securely receiving the corresponding locking members 73. The shield 72 defines a pair of cutouts 78 and a pair of through holes 79 at positions corresponding to the apertures 74 of the housing 70. Each locking member 73 forms a cantilevered arm 76 having a hook 77 at a free end thereof and a cavity 75 corresponding to the cutout 78 and the through hole 79 of the shield 72. Each locking member 73 is received in the corresponding aperture 74 of the housing 70 with the arm 76 extending through the corresponding cutout 78 of the shield 72. The locking member 73 is attached to the housing 70 and the shield 72 by a fastening member such as a screw (not shown), extending through the cavity 75 and the through hole 79.

However, since the locking member 73 is relatively large, the aperture 74 of the housing 70 weakens the integrity of the housing 70. In addition, since the hook 77 only engages with a locking member of the mating connector (not shown) at a predetermined position, any deviation therebetween will hinder proper engagement. Further, disengagement between the two mated connectors is complicated since the locking members 73 are not provided with an accessible disengaging device. Hence, an improved electrical connector is required to overcome the disadvantages of the prior art.

BRIEF SUMMARY OF THE INVENTION

A first object of the present invention is to provide a locking device having effective guiding means for locking/unlocking two members of the locking device with a minimal force.

A second object of the present invention is to provide a locking device taking on a limited space in an insulative housing of an electrical connector in which the locking device is assembled.

Accordingly, a locking device for engaging first and second mating connectors together comprises first and second locking members respectively retained in the first and second connectors. The first locking member has a globular engaging portion extending beyond the first connector. The second locking member has a U-shaped latch extending beyond the second connector. The latch forms an arcuate cutout in a free end thereof. The latch provides a pair of beveled edges on opposite periphery of the cutout. The engaging portion of the first locking member slides through the cutout to engage with the latch of the second locking member aided by the beveled edges of the cutout. A rear face of the engaging portion abuts the free end of the latch to establish secure engagement between the first and second locking members.

Other objects, advantages and novel features of the invention will become more apparent from the following detailed description of the present embodiment when taken in conjunction with the accompanying drawings.

DETAILED DESCRIPTION OF THE INVENTION

Figure 1:
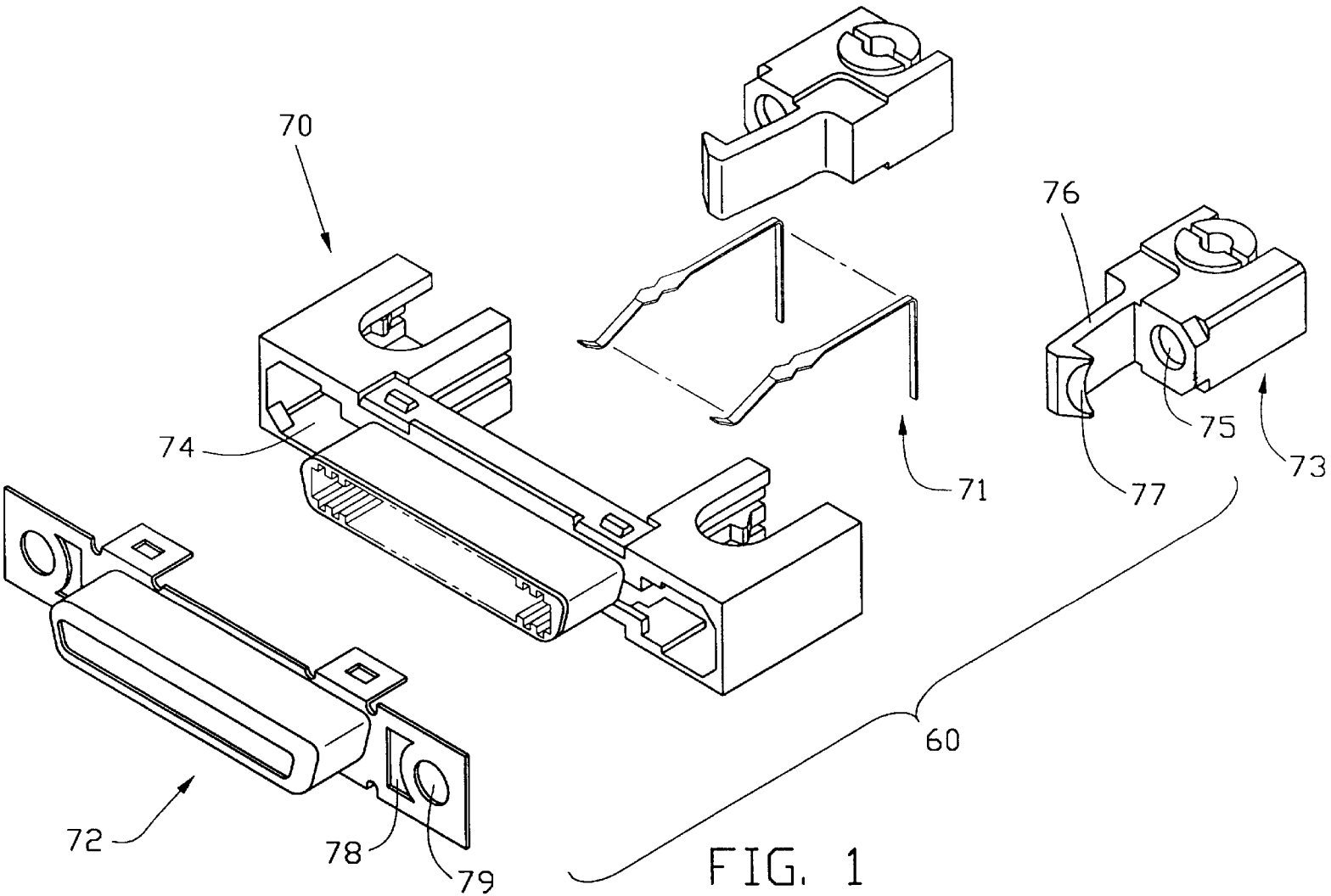
FIG. 1 (PRIOR ART)
FIG. 1 is an exploded view of an electrical connector incorporating a conventional locking device.
Figure 2:
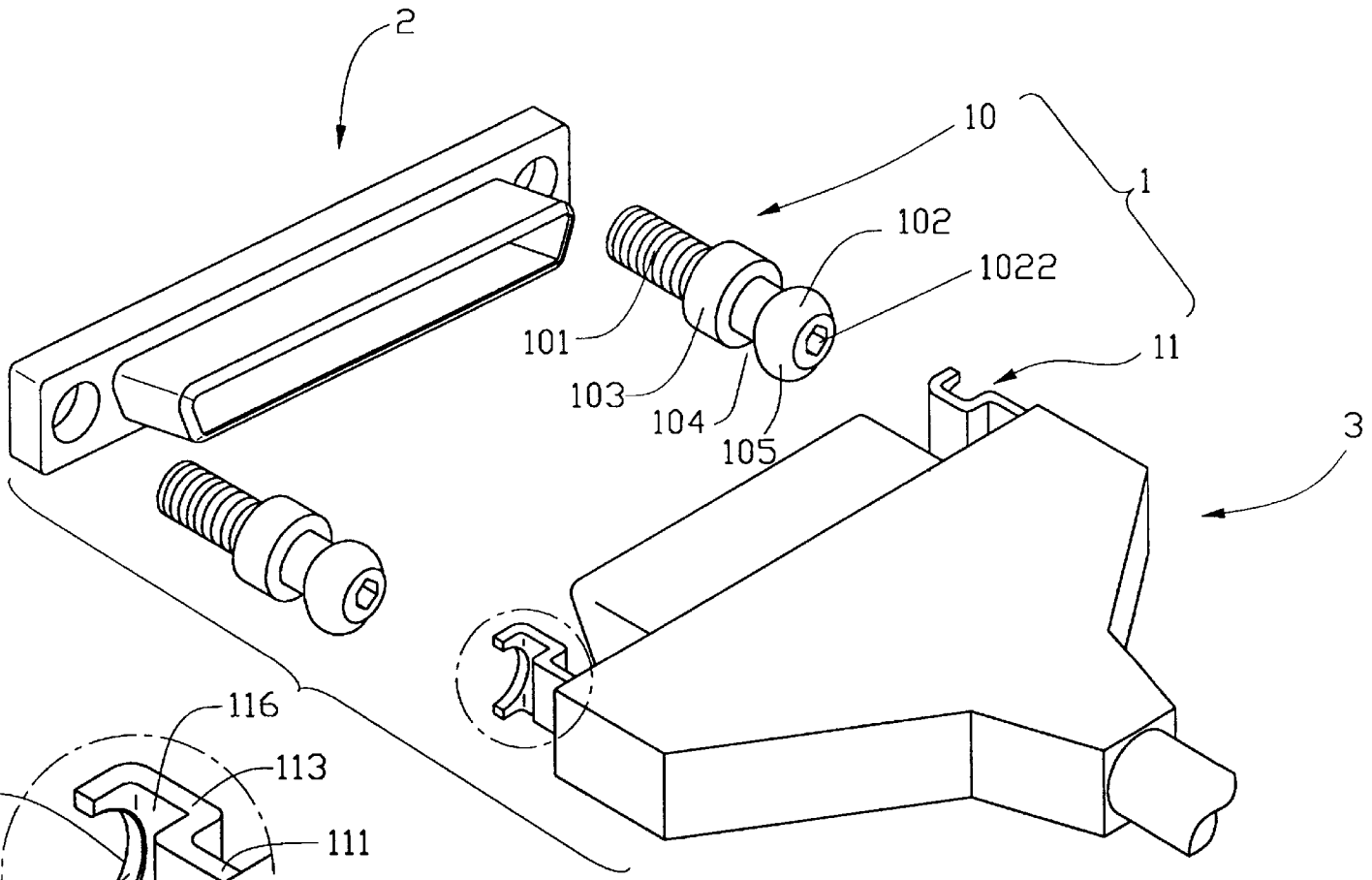
FIG. 2 is an exploded view of two mating electrical connectors and a pair of locking devices in accordance with the present invention.
Figure 3:
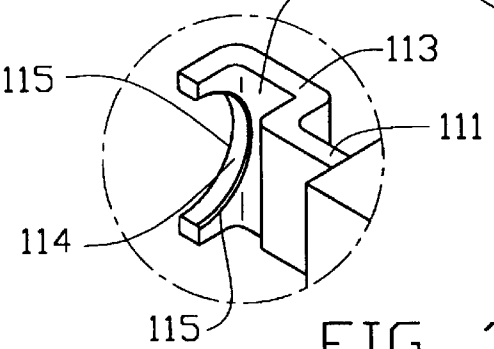
FIG. 3 is a partial enlarged view of FIG. 2.

Referring to FIGS. 2 and 3, a locking device 1 for engaging a first connector 2 and a second connector 3 together comprises a first locking member 10 and a second locking member 11. The first locking member 10 has a screw portion 101 forming threads thereon and a globular engaging portion 102 opposite the screw portion 101. The screw portion 101 is received in a mating face of the first connector 2 while the engaging portion 102 extends beyond the mating face of the first connector 2. The second locking member 11 comprises a mounting portion 111 for being retained in a mating face of the second connector 3 and a U-shaped latch 113 defined by two transverse sections connected by a lengthwise section and defining a chamber 116 therein, and an arcuate cutout 114 in a free end thereof for receiving the engaging portion 102. A projection 103 is formed proximate the engaging portion 102, and a gap 104 is defined therebetween. The engaging portion 102 defines a hexagonal opening 1022 at a free end thereof for screwing the first locking member 10 into the first connector 2. A pair of beveled edges 115 are formed on periphery of the cutout 114 for facilitating guidance of the engaging portion 102 into/out of the latch 113. An angle 'A' (FIG. 4) larger than 90 degrees is formed between the free end of the latch 113 and a proximate section.

Figure 4:
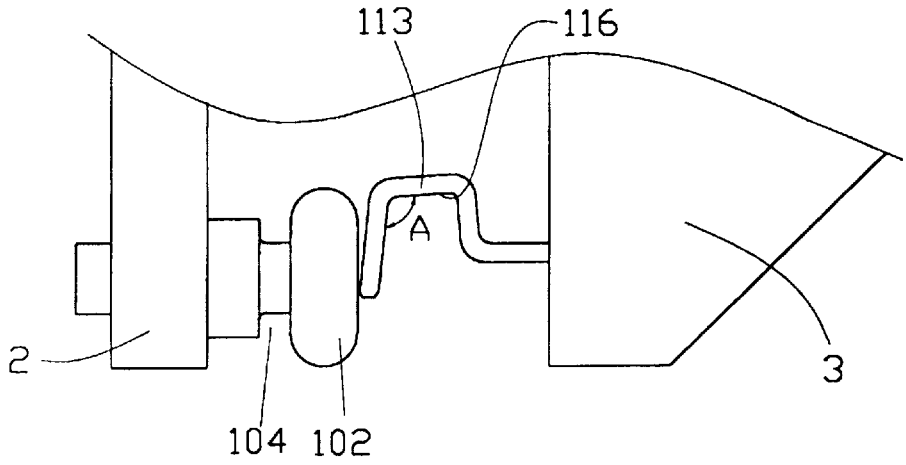
FIGS. 4–6 are partial top views showing two members of the locking device being sequentially engaged together.
Figure 5:
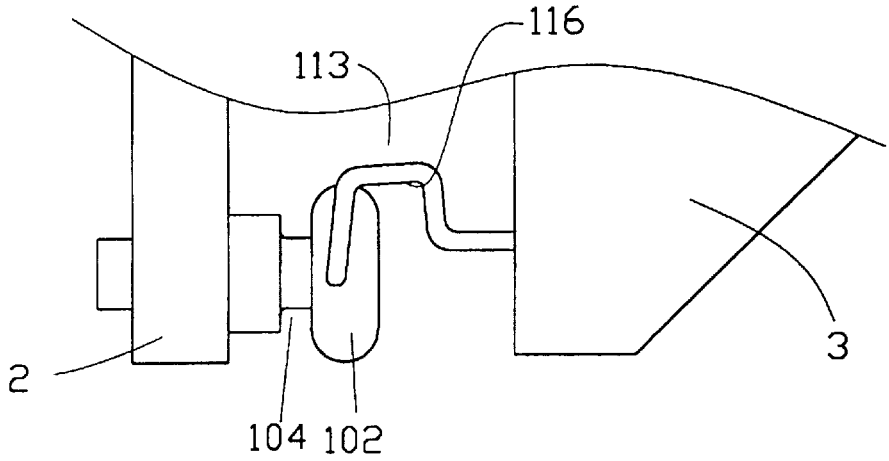
Figure 6:
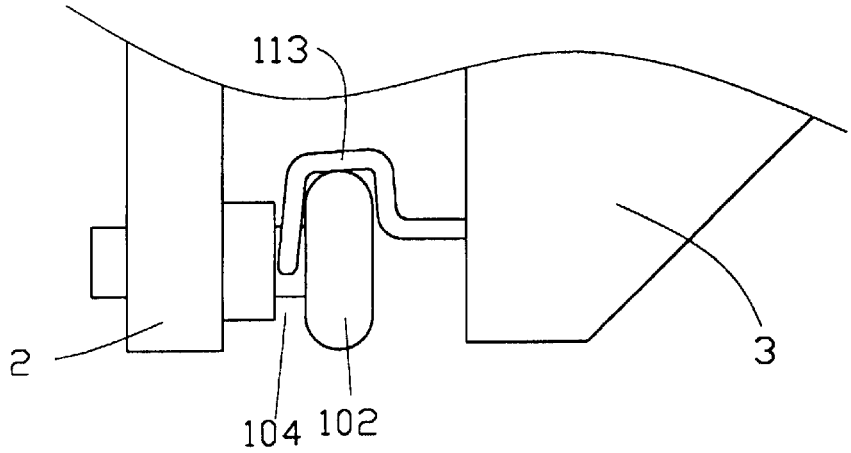

Referring to FIGS. 4–6, when the first connector 2 is mated with the second connector 3, the cutout 114 of the latch 113, particularly the beveled edge 115, slides along the globular engaging surface 105 of the engaging portion 102. The latch 113 is supported by the globular engaging surface 105 and a stress is formed therebetween which causes the latch 113 to deflect as the beveled edge 115 slides along the engaging surface 105. The latch 113 further deflects as the beveled edge 115 slides along the engaging surface 105 until a portion of the engaging portion 102 having the largest diameter is passed. Then the beveled edge 115 continues sliding along the engaging surface 105 until the free end of the latch 113 is received in the gap 104 and the engaging portion 102 received in the chamber 116 of the second locking member 11 and the latch 113 resumes its original shape. The free end of the latch 113 then abuts against a rear face of the engaging portion 102 to securely engage the first and second locking members 10, 11 together.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A locking device for engaging first and second mating electrical connectors together, comprising:

a first locking member retained in the first connector, the first locking member forming a globular engaging portion at a free end thereof; and a second locking member retained in the second connector, the second locking member having a U-shaped latch defining a chamber and a cutout at a free end thereof, the latch being resiliently displaceable by the globular engaging portion, the globular engaging portion of the first locking member being received in the chamber of the second locking member via the cutout, the globular engaging portion having a rear face which securely abuts a periphery of the cutout thereby securely engaging the first locking member with the second locking member.

2. The locking device as claimed in claim 1, wherein the first locking member comprises a projection formed at a position proximate the globular engaging portion and a gap defined between the projection and the globular engaging portion.

3. The locking device as claimed in claim 1, wherein the first locking member has a mounting portion opposite the globular engaging portion, the mounting portion forming threads thereon for securely engaging with the first connector.

4. The locking device as claimed in claim 3, wherein the globular engaging portion defines a hexagonal opening at a free end thereof for screwing the first locking member into the first connector.

5. The locking device as claimed in claim 1, wherein a pair of beveled edges are formed on the periphery of the arcuate cutout for facilitating guidance of the globular engaging portion of the first locking member into and out of the chamber of the second locking member.

6. A locking device for engaging first and second electrical mating connectors together, comprising:

a stiff first locking member retained in the first connector which is fixed in position, said first locking member forming an engaging portion at an end thereof;

a resilient second locking member retained in the second connector which is moveable with regard to the first connector, said second locking member including a U-shaped latch at a distal end, said U-shaped latch defining two transverse to form a chamber sections bridged by a lengthwise section whereby one half of said first locking member is latchably received within the chamber while the other half lies outside of the chamber.

* * * * *